US005964673A

United States Patent [19]

MacKay, Jr.

[11] Patent Number: 5,964,673

[45] Date of Patent: *Oct. 12, 1999

[54] HOLLOW METAL BAT WITH STIFFENED TRANSITION ZONE AND METHOD OF MAKING SAME

[75] Inventor: Jack W. MacKay, Jr., Mt. Pleasant, Tex.

[73] Assignee: Hellerich & Brasby Co., Louisville, Ky.

[ * ] Notice: This patent issued on a continued prosecution application filed under 37 CFR 1.53(d), and is subject to the twenty year patent term provisions of 35 U.S.C. 154(a)(2).

[21] Appl. No.: 08/791,464

[22] Filed: Jan. 27, 1997

[51] Int. Cl.[6] ..... A63B 59/06

[52] U.S. Cl. ..... 473/566

[58] Field of Search ..... 473/566, 567

[56] References Cited

U.S. PATENT DOCUMENTS

| | | | |
|---|---|---|---|
| 2,023,131 | 12/1935 | Gibson | 273/80 |
| 3,334,901 | 8/1967 | Steffes | 273/68 |
| 3,727,295 | 4/1973 | Gildemeister | 29/455 |
| 3,762,707 | 10/1973 | Santorelli | 273/80 B |
| 3,861,682 | 1/1975 | Fujii | 473/566 |
| 4,056,267 | 11/1977 | Krieger | 273/72 A |
| 4,505,479 | 3/1985 | Souders | 273/72 A |
| 4,746,117 | 5/1988 | Noble et al. | 273/72 A |
| 4,834,370 | 5/1989 | Noble et al. | 273/72 A |
| 5,180,163 | 1/1993 | Lanctot et al. | 273/73 R |
| 5,316,300 | 5/1994 | Simmons | 273/80 R |
| 5,380,003 | 1/1995 | Lanctot | 273/72 R |
| 5,393,055 | 2/1995 | MacKay, Jr. | 273/72 A |
| 5,421,572 | 6/1995 | MacKay, Jr. | 273/72 A |
| 5,494,280 | 2/1996 | MacKay, Jr. | 273/72 A |
| 5,575,722 | 11/1996 | Saia et al. | 473/300 |

*Primary Examiner*—Mark S. Graham

*Attorney, Agent, or Firm*—Middleton & Reutlinger; John F. Salazar; Charles G. Lamb

[57] ABSTRACT

A tubular metal ball bat including a tubular barrel having a hitting zone at the distal end thereof, a handle at a proximal end thereof and a tapered transition zone connecting the hitting zone to the handle and a method of making same. The transition zone is provided with a stiffening transverse wall generally at the junction between the hitting zone and transition zone. In one form, a hardenable material is poured into the distal end of the bat through an opening in the distal end after a sponge-like member of foam plastic or similar resilient foam material has been inserted through the opening and forced into the barrel generally to the junction between the hitting zone and transition zone. The sponge-like member is frictionally held in place initially by its resilient contact with the interior of the bat barrel to accurately orient the hardenable material and prevent the hardenable material from running downwardly to the handle end of the bat while the hardenable material hardens. When the hardenable material solidifies, it attaches to open cells in the sponge-like material and to the inner surface of the barrel to form a continuous transverse wall across the barrel interior. In another embodiment, a disk-like member is inserted through an open bat distal end before assembling the end cap and the disk-like member is glued in position to form the stiffening transverse wall.

10 Claims, 3 Drawing Sheets

HOLLOW METAL BAT WITH STIFFENED TRANSITION ZONE AND METHOD OF MAKING SAME

BACKGROUND OF THE INVENTION

1. Field of the Invention

This invention relates to a tubular metal ball bat, such as a baseball bat or a softball bat, which includes a tubular barrel having a hitting zone at the distal end, a handle at the proximal end and a tapered transition zone connecting the hitting zone to the handle, and to a method of making the same. More specifically, the present invention is directed to a tubular metal ball bat in which the transition zone is provided with a transverse wall or reinforcing element of a generally rigid material adjacent the juncture between the hitting zone and transition zone which tends to stiffen the proximal end of the hitting zone, isolate the hitting zone from the transition zone and handle, control the balance of the bat and its center of gravity and regulate the impact area of the bat hitting zone.

2. Description of the Prior Art

Hollow metal bats of aluminum or similar material have been developed and have been used when playing baseball, softball and the like for many years. Various improvements have been made in the construction of these hollow metal bats since their introduction. Included in such developments are the subjects of my U.S. Pat. Nos. 5,393,055 issued Feb. 28, 1995, 5,421,572 issued Jun. 6, 1995, and 5,494,280 issued Feb. 27, 1996. In addition, the distal end of such bats has traditionally been reinforced by various closure caps and constructions. Efforts have also been made to cushion and reinforce the bat by completely filling the interior of the bat with a foam material and by making other improvements. The following U.S. patents illustrate various developments in this field of endeavor:

| | | |
|---|---|---|
| 3,727,295 | 4,746,117 | 5,180,163 |
| 4,056,267 | 4,834,370 | 5,380,003 |
| 4,505,479 | | |

The above patents disclose bats filled with foam to increase the strength of the bat. Additionally, the above patents disclose the addition of a weight member in the handle portion of the bat for weighting and balancing the bat handle.

The prior art does not disclose, however, a transverse wall or reinforcing segment at or near the juncture of the hitting zone and the transition zone of a tubular metal bat as contemplated by the present invention. Further, the prior art does not teach a method for forming such transverse wall or reinforcing segment which stiffens the proximal end of the hitting zone of the bat and serves to isolate the hitting zone from the transition zone and handle.

SUMMARY OF THE INVENTION

In accordance with the present invention, a transition wall or reinforcing element is formed or positioned at or near the juncture between the hitting zone and the transition zone thereby to stiffen the transition zone at its juncture with the hitting zone and serve to isolate the hitting zone from the transition zone and handle.

In one embodiment, the transverse wall is preferably formed of a hardenable material that is poured into an open distal end of the barrel of the bat after a sponge-like member of foam plastic, foam rubber or similar resilient foam material has been forced into the open distal end and positioned generally at or near the juncture between the hitting zone and transition zone. The sponge-like member is so dimensioned that it will be frictionally held in place in its selected location by its resilient contact with the interior of the bat barrel. When the hardenable material is then poured into the bat barrel, the hardenable material will be retained at the surface and adjacent open cells or interstices of the sponge-like member, which also prevents the hardenable material from running downwardly to the handle end of the bat while the hardenable material is hardening or curing. The sponge-like member thus can accurately position the hardenable material in its selected position within the bat barrel. The sponge-like member is preferably in the form of a ball which retains the hardenable material in a desired position near the distal end of the transition zone or proximal end of the hitting zone.

In an alternate embodiment, the transverse wall or reinforcing element can be preformed, in the form of a preformed disk, cylinder or the like, which fits snugly into the interior of the bat barrel at or near the juncture between the transition zone and hitting zone and is glued or otherwise adhered in place. The preformed disk can be formed of plastic, elastomeric or other moldable material with the desired stiffening and reinforcing characteristics for the bat barrel, such as strength, weight, size, shape, length, density, etc.

The transverse wall, whether formed from a hardenable material or inserted as a preformed component, reinforces and stiffens the transition zone at its juncture with the hitting zone. It has been found that this reinforcement and stiffening tends to increase or enhance the trampoline effect of the hitting zone of the bat and also isolates the hitting zone to reduce transfer of vibrations to the handle of the bat thus reducing vibrations that may be imparted to the hands of the batter when gripping the bat and hitting a ball at the hitting zone. The transverse wall also tends to regulate the trampoline action so that equal trampoline action occurs on opposed surfaces of the ball at impact with the bat to provide maximum trajectory to the ball. The transverse wall effectively lengthens the "sweet spot" in the hitting zone.

In addition, it has been found that the introduction of a transverse wall or reinforcing segment at or near the distal end of the transition zone provides a bat weight distribution capability which reduces the weight at the distal end of the bat and moves some weight toward the handle. Hence, the center of balance of the bat is oriented closer to the handle. Further, the quantity and density of the hardenable material or preformed component can be adjusted to control the weight balance and distribution. Such a weight control and distribution permits a faster swing thus providing greater power upon ball impact. Once the hardenable material has been poured into the bat barrel onto the sponge-like retaining member through the distal end of the bat, or the preformed component inserted and glued into position, the distal end of the bat can be closed with an appropriate end cap or other closure as is known in the art.

It is therefore an object of the present invention to provide a hollow metal ball bat having a hitting zone at one end, a handle at the opposite end and a tapered transition zone interconnecting the hitting zone and the handle with a transverse wall or reinforcing element positioned generally at the juncture between the hitting zone and transition zone for stiffening the transition zone, isolating the hitting zone from the transition zone and handle, regulating the impact area of the hitting zone, enhancing the trampoline effect of the hitting zone and enabling adjustment of the balance characteristics of the bat by varying the quantity and density of the transverse wall and adjusting the position of the transverse in relation to the hitting zone and transition zone.

Another object of the invention is to provide a hollow metal bat in accordance with the preceding object in which a hardenable material forms the transverse wall as a continuous transverse barrier in the interior of the tubular bat generally at the juncture area between the transition zone and the hitting zone. A resilient sponge-like member, preferably in the shape of a ball, is positioned in the transition zone by insertion through the open distal end of the bat and forced to a predetermined longitudinal position. The diameter or perimeter dimension of the sponge-like member is greater than the interior diameter of the bat barrel so that the resilient sponge-like material, such as foam plastic or foam rubber, will compress into and frictionally engage the interior wall of the tubular barrel and anchor itself in the position to which it is forced. The ball member then serves as a retaining member to position the hardenable material that is poured into the open end of the barrel while in a flowable or liquid state and retains the hardenable material in place while hardening or curing. The hardenable material is balanced about the longitudinal axis of the bat and forms a weight, as well as a wall or barrier, for adjusting the balance of the bat along its longitudinal extent, as well as isolating the hitting zone from the transition zone for dampening vibrations being transferred from the hitting zone to the handle and enhancing the trampoline effect of the hitting zone of the bat.

A further object of this invention is to provide a hollow metal ball bat in accordance with the preceding objects in which the structure isolating the hitting zone from the transition zone includes at least two retaining elements in the form of two spherical sponge balls or similar shaped sponge material that are sequentially placed in the transition zone. After the first sponge material has been positioned in the distal end of the transition zone, hardenable material is poured into the open distal end of the bat onto the first sponge member. Subsequently, a second ball of sponge-like material is positioned through the open distal end of the bat into contact with the hardenable material and a second quantity of hardenable material is poured into the open end of the bat into contact with the second ball. This enables the hardenable material to be oriented in longitudinally spaced relation in the transition zone adjacent its juncture with the hitting zone and enables the weight of the hardenable material not only to be varied but also to be spaced along the length of the transition zone for more effectively isolating vibrations from passing into the transition zone and further enhancing the trampoline effect of the hitting zone.

Still another object of this invention is to provide a hollow metal ball bat in which the transverse wall structure isolating the hitting zone from the transition zone is a preformed disk-like component inserted into the open distal end of the bat barrel and glued into position in the interior of tubular bat generally at the juncture area between the transition zone and the hitting zone. The preformed disk-like component is balanced about the longitudinal axis of the bat and forms a weight, as well as the wall or barrier, for adjusting the bat balance and center of gravity, as well as dampening vibrations transferred from the hitting zone to the handle and regulating and enhancing the trampoline effect of the hitting zone of the bat.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
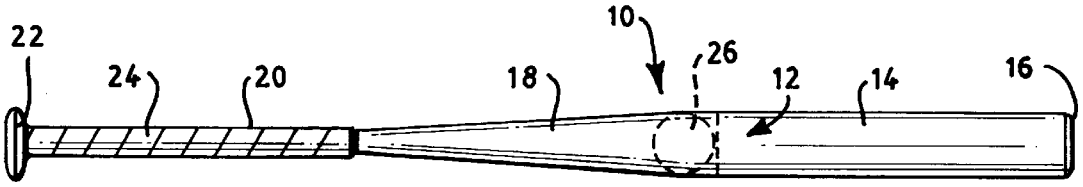
FIG. 1 is an elevational view of a tubular hollow metal bat in accordance with the present invention, with the transition zone stiffening structure illustrated by broken lines.

In describing the preferred embodiments of the present invention as illustrated in the drawings, specific terminology will be resorted to for the sake of clarity. However, the invention is not intended to be limited to the specific embodiments illustrated and terms so selected; it being understood that each specific term includes all technical equivalents which operate in a similar manner to accomplish a similar purpose.

As illustrated in FIG. 1, the tubular hollow metal bat 10 includes a hollow barrel 12 extending substantially throughout the length thereof. Bat 10 includes a hitting zone 14 which is closed at the distal or outer end of the bat with end closure 16. The bat barrel 12 includes a tapered hollow transition zone 18 forming a continuation of the proximal end of the hitting zone 14 and merging into the tubular handle 20. The handle 20 terminates in a knob 22 on the proximal end of the bat with the handle including a covering 24 to enhance the gripping capability of a person using the bat.

At the proximal end of the hitting zone 14 at approximately the juncture between the hitting zone 14 and transition zone 18, a retaining member in the form of a resilient sponge-like ball 26 is positioned by inserting it through an opening in the distal end of the barrel 12 before end closure 16 has been installed. The sponge-like ball 26 is preferably constructed of foam plastic or foam rubber or other material which can compress down in size and act to retain a flowable hardenable material. The ball 26 has an external diameter or perimeter dimension which is greater than the interior diameter of the barrel 12 so that the ball will resiliently retain its position when forced into the interior of the barrel. This enables the sponge-like ball 26 to be inserted to and retained in a predetermined position in the transition zone adjacent its juncture with the hitting zone.

Figure 2:
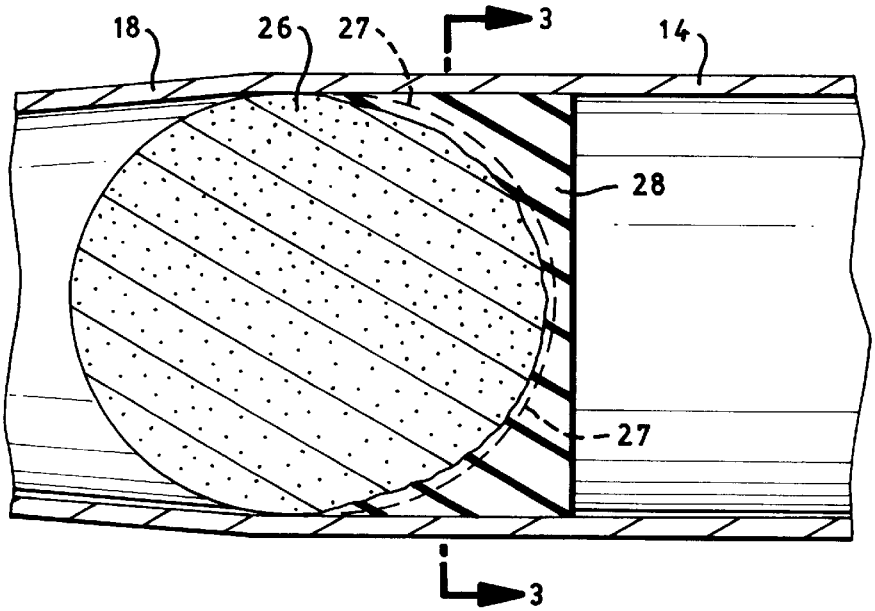
FIG. 2 is a longitudinal sectional view, on an enlarged scale, illustrating the juncture between the hitting zone and transition zone with the transverse wall formed by the hardenable material and sponge-like resilient retaining member.
Figure 4:
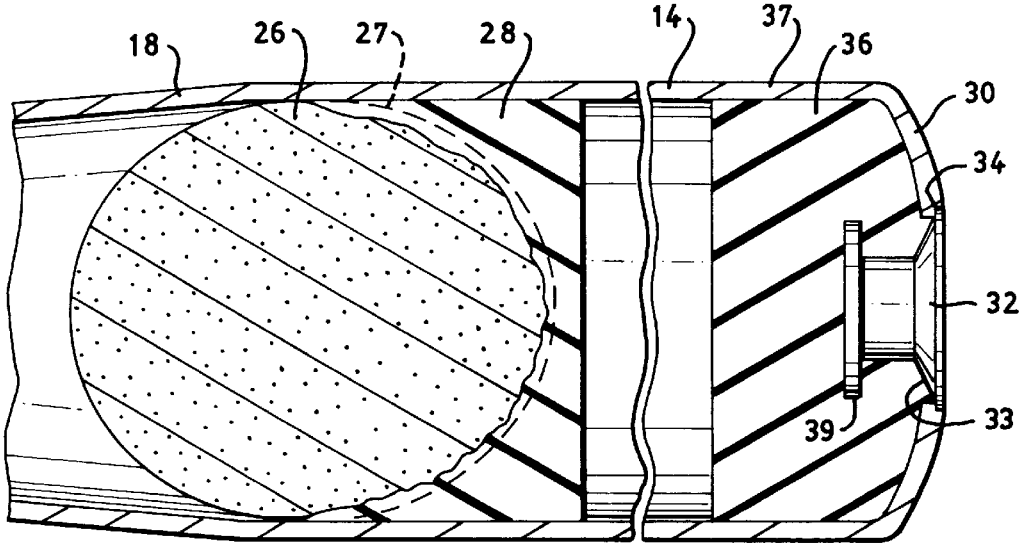
FIG. 4 is a view similar to FIG. 3 but illustrating the stiffening transverse wall and the closure structure for the distal end of the bat thus reinforcing both ends of the broken away hitting zone of the bat.
Figure 5:
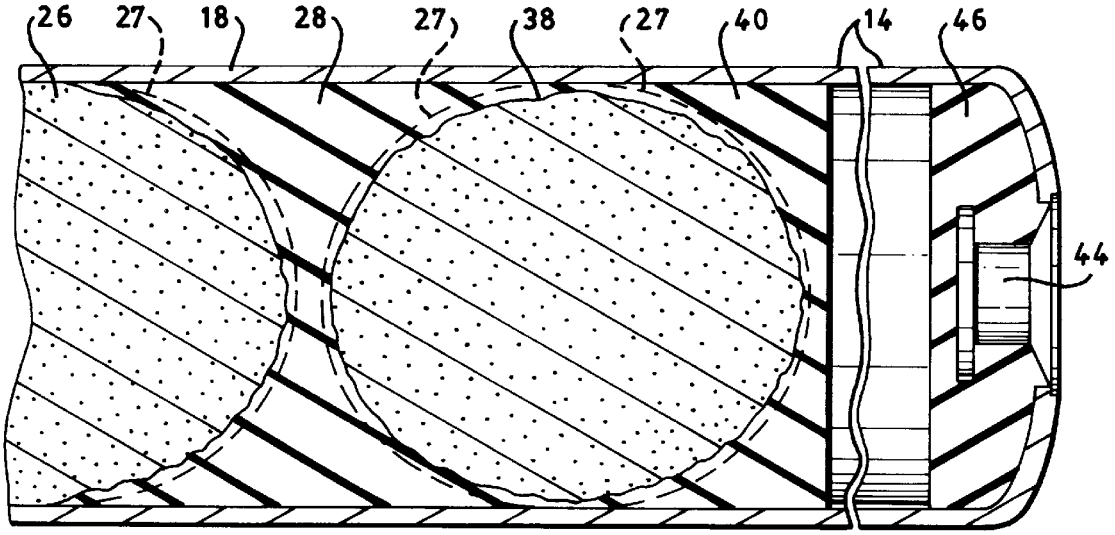
FIG. 5 is a sectional view similar to FIG. 4 but illustrating the insertion of two spaced sponge-like members with two areas of hardenable material associated therewith to enable sequential positioning of transverse walls or barriers of hardenable material in the area of the bat at the juncture of the transition zone and hitting zone.

As illustrated in FIGS. 2, 4 and 5, the original spherical shaped ball 26 is compressed as it is inserted into the interior of the barrel and assumes a generally elliptical shape. The resilient construction of the ball tends to return it to its original spherical configuration thereby frictionally and sealingly engaging the interior of the bat completely around the circumference of the ball to retain the ball in place and prevent flow of hardenable material past the ball.

A hardenable material 28, such as urethane or the like, is then poured into the open distal end of the barrel 12 when the bat is generally in a vertical position so that the hardenable material flows downwardly into engagement with the sponge-like ball 26. The ball 26 thus forms a retaining member or barrier for the hardenable material 28 so that the hardenable material will flow around the surface of the sponge-like ball 26 facing the open distal end and into its surface interstices, as indicated by the numeral 27, but the sponge-like ball 26 will prevent the hardenable material from flowing past it further into the transition zone. By retaining the bat in a vertical position while the hardenable material hardens, the hardenable material will harden uniformly about the longitudinal axis of the bat for balancing the hardenable material about such longitudinal axis.

The hardenable material 28 extends across the interior of the bat barrel and thus forms a continuous wall or barrier to isolate the interior of the hitting zone 14 from the interior of the transition zone 18. This continuous wall or barrier serves to define the proximal end of the impact zone of the bat and enhances the trampoline effect of the hitting zone, inasmuch as the hardenable material is substantially rigid and stiffens the transition zone and the proximal end of the hitting zone. Also, the hardenable material provides a weight which can balance the bat at a desired location in relation to the longitudinal extent of the bat thereby enabling the balance characteristics of the bat to be adjusted by adjusting the quantity and density of the hardenable material positioned in the bat barrel. The hardenable material which is substantially rigid but has some degree of resiliency also isolates or dampens vibrations from transferring from the hitting zone to the transition zone and thus to the handle thereby enabling a person using the bat to strike the ball at different locations in the hitting zone without "stinging" the hands gripping the bat. The transverse wall also lengthens the "sweet spot" of the hitting zone by equalizing the trampoline effect throughout the length of the hitting zone and equalizes the trampoline effect on each side of a ball impacting the hitting zone. Also, the transverse wall enables movement of weight toward the handle end of the bat for adjustment of bat balance, thus providing less weight distribution toward the distal end of the bat. Such weight distribution permits a faster swing and hence greater power upon ball impact.

FIG. 4 illustrates the same construction of the sponge-like ball 26 and hardenable material 28 in the bat barrel. In the illustrated construction, the end of the bat barrel 12 is inturned at 30 and includes a cylindrical closure plug 32 to close distal opening 33. The peripheral edge of plug 32 engages a shoulder 34 on the inner periphery of the inturned end 30 defining opening 33. Hardenable resilient material 36 is also inserted into the distal end 37 of the hitting zone to secure the plug 32 in place by engagement with the plug surface and enlargement 39. The hardenable material 36 can be formed in the distal end 37 in any convenient manner. For example, after hardenable material 28 has hardened and the transverse wall has been formed in the transition zone, material 36 in a flowable or liquid state can be introduced into the barrel 12 through opening 33. Plug 32 is then inserted into opening 33 and the bat turned vertically with the distal end downward. The material 36 then flows around plug 32, engaging its surface and enlargement 39, to harden into the configuration illustrated. In this way the material 36 will harden uniformly about the longitudinal axis of the bat. Enlargement 39 embedded in hardenable material 36 assists in holding the hardenable material 36 in place at the distal end of the bat and hitting zone 14.

Figure 3:
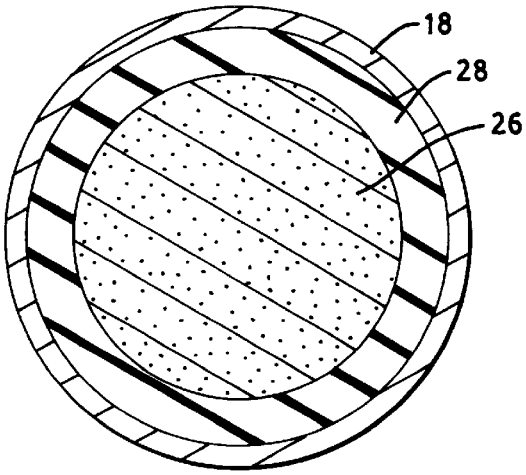
FIG. 3 is a transverse, sectional view taken along section line 3—3 on FIG. 2 illustrating the structural relation of the hardenable material and the sponge-like material in relation to the interior of the bat.

FIG. 5 illustrates an arrangement in which an initial sponge-like ball 26 is positioned in the transition zone and hardenable material 28 is poured into the end of the bat so that it can harden in the same manner described in connection with FIGS. 2 and 3. Before the hardenable material 28 has been cured or hardened, a second spherical ball 38 is positioned in the transition zone 18 and a second quantity of hardenable material 40 is poured into the open end of the bat for flowing downwardly into contact with the spherical sponge-like ball 38. As shown, the hardenable materials 28 and 40 penetrate into the open cells adjacent the facing surfaces of balls 26 and 38, as indicated by the numeral 27. This provides additional isolation of the hitting zone from the transition zone and handle and enables further adjustment of the balance characteristics of the bat. Thus, this arrangement further isolates vibrations encountered when striking the ball in the hitting zone from transferring down the barrel through the transition zone and into the handle by absorbing vibrations in two continuous transverse areas of hardenable material rather than one. The end of the bat barrel in FIG. 5 is inturned at 42 and is provided with a plug 44 and resilient hardenable material 46 forming an end cap which functions in the same manner as described above in connection with FIG. 4.

In the embodiment illustrated in FIG. 6, the bat barrel includes the same construction of the sponge-like ball 26 and hardenable material 28 as previously described in connection with the embodiment shown in FIGS. 2–4; whereas, the distal end of the bat barrel includes an open distal end and end cap such as disclosed in FIGS. 1–3 of my copending application, Ser. No. 06/396,225, filed Feb. 28, 1995. As shown, the hitting zone 14 is generally straight to the open distal end 50 and includes a shallow recess 52 and an internal ridge 54 at the distal end 50. An end cap 56 forms a closure for the open distal end 50 and includes a solid outer end 58 having an outer periphery 59 that is substantially the same external diameter as the distal end of the bat. The end cap 56 also includes a short sleeve 60 which telescopes into the distal end of the bat. The sleeve 60 includes a peripheral groove 62 which receives the ridge 54 on the distal end of the bat thus serving to anchor the end cap 56 in the distal end 50 of the bat.

Figure 6:
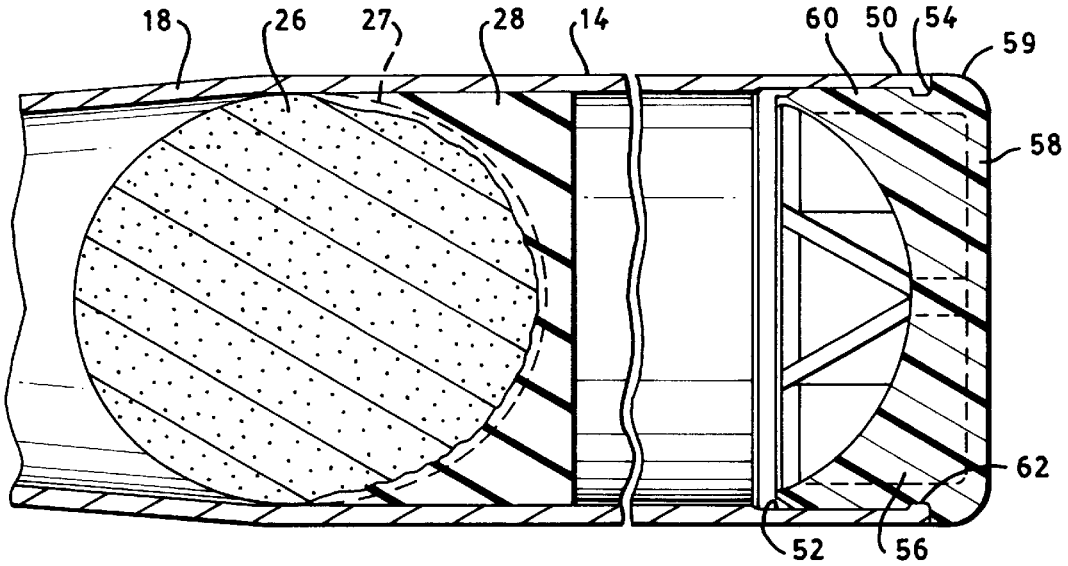
FIG. 6 is a sectional view similar to FIG. 4 illustrating an embodiment in which the distal end of the bat is substantially straight and closed by an end cap.
Figure 7:
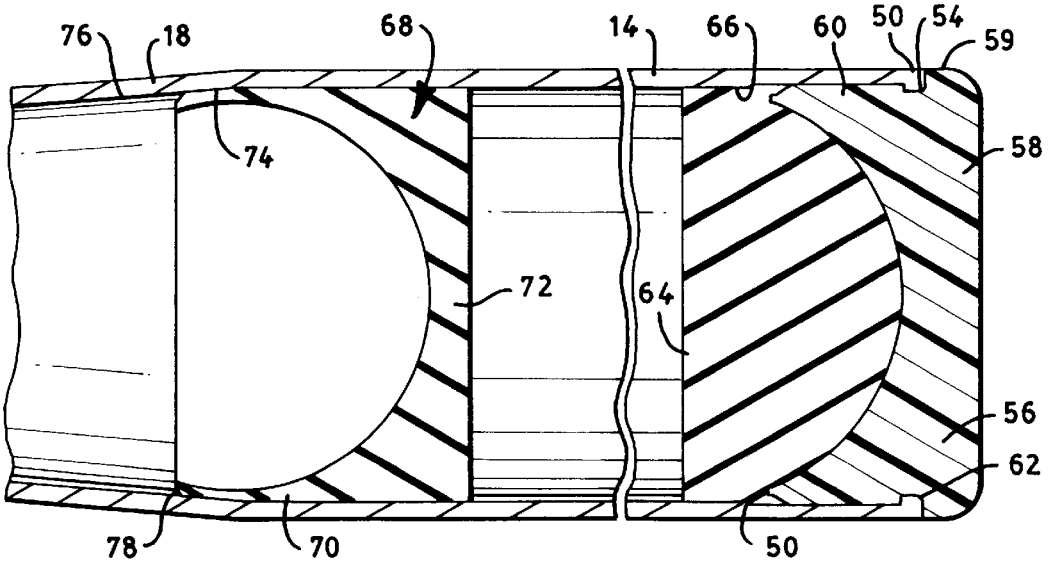
FIG. 7 is a sectional view similar to FIG. 6 in which the end cap and distal end of the bat include an area of hardenable material and the transverse wall or reinforcing element is formed by a preformed component glued in place.

Turning now to the embodiment illustrated in FIG. 7, the distal end 50 and end cap 56 are identical to that shown in FIG. 6, except that hardenable material 64 fills and is bonded to the interior of the end cap and an adjacent portion 66 of the interior surface of the bat barrel. The end cap and hardenable material in FIG. 7 function in a similar manner as described in connection with FIGS. 4 and 5 by stiffening the hitting zone and enabling weight adjustment of the distal end of the bat.

The bat construction illustrated in FIG. 7 includes an alternate embodiment for the transverse wall or reinforcing element in accordance with the present invention. More specifically, a preformed disk or cylinder, generally designated by the numeral 68, is positioned in the interior of the bat barrel at approximately the juncture between the hitting zone 14 and the transition zone 18 by insertion through the open distal end 50 of the bat before insertion of the end cap 56. Disk 68 is preferably cup-shaped with a generally cylindrical wall 70 engaging the interior wall of the tubular barrel and a stiffening transverse wall 72 extending across the barrel interior. Disk 68 is preferably tapered at its forward end, as at 74, so as to engage the decreasing diameter 76 of the bat barrel at the beginning of the transition zone 18. The leading edge 78 of the disk 68 is also preferable chamfered to facilitate insertion in the distal end 50. The transverse wall 72 of disk 68 is preferably solid in order to provide the requisite stiffening, although one or more holes may be formed therein. The disk 80 is fixed in position within the barrel by applying any appropriate glue or other adhesive to the outside surface of the cylindrical wall 70 prior to insertion, and allowing the glue or other adhesive to dry or set up once the disk 68 has been properly positioned within the bat barrel.

The retaining members 26 and 38 used in the FIG. 2–6 embodiments of the present invention are preferably a resilient sponge-like material, such as foam plastic or foam rubber, to provide both a compressible barrier to frictionally engage the interior wall of the bat barrel at the selected position and to block flow of the hardenable material in its flowable state, as well as provide open cells or interstices in the material to receive a portion of the hardenable material for strength and retention of the retaining member in the hardenable material. Further, the ball or generally spherical shape of the retaining members is preferred. However, other materials and shapes may be utilized if they perform the necessary blocking and foundation functions for forming the transverse wall or isolating element in the transition zone adjacent the proximate end of the hitting zone. In addition, while insertion of the retaining member 26, or retaining members 26 and 38, and the hardenable materials 28 and 36, (FIG. 4), or the hardenable materials 28, 40 and 46 (FIG. 5) is preferably through an opening in the distal end of the bat barrel before insertion of an end cap or other closure, it is possible that insertion can be accomplished through an open handle end before the knob is welded in place, or in an opening in the knob.

Many other closure assemblies and end caps can be used in accordance with the present invention in addition to those disclosed in the instant drawings, including those disclosed in my earlier U.S. patents as well as the others disclosed in my aforesaid co-pending application. While a hardenable material at the distal end, such as hardenable materials 36, 46 and 64 is not always necessary, since the end cap or other closure structure alone can serve to stiffen the distal end as shown in FIG. 6, a hardenable material is preferred not only to retain the closure element, for example as illustrated in FIGS. 4, 5 and 7, but also to balance the stiffening member at the proximate end of the hitting zone formed by hardenable material 28 or disk 68. Further, the hardenable materials for the transversal wall and the distal end can be the same or different compositions depending on the weight and stiffening characteristics desired and either or both may include weighted particles or foaming agents to vary the density of the stiffening member at each end of the hitting zone. Similarly, the disk 68 can be similarly weighted or lightened.

Since hardenable material 36 serves to stiffen the distal end of the hitting zone, it will be seen that the hitting zone 18 is stiffened at both ends in accordance with the present invention. In other words, the hitting zone 18 is stiffened at its proximate end by the stiffening transverse wall formed by hardenable material 28 or preformed disk 68, and at its distal end by hardenable material 36. It has been found that the hitting zone is thus isolated by these two stiffening components, one at each end, which thus permits a manufacturer to regulate the impact area of the hitting zone and enhance the trampoline effect of the hitting zone when the hitting zone strikes a ball upon impact.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A metal bat having a tubular barrel with a closed distal end and a proximal end and including a hitting zone adjacent the distal end, a handle adjacent the proximal end, a transition zone between the handle and hitting zone and said bat including only a single interior stiffening transverse wall between the proximal and distal ends, said wall being positioned in the bat barrel approximately at the Juncture between the hitting zone and transition zone;

wherein said stiffening transverse wall is constructed of a hardenable material positioned in the bat barrel;

wherein said hardenable material is poured into an open end of the bat into engagement with a sponge-like member previously inserted into said open end.

2. The metal bat as defined in claim 1 wherein said hardenable material is continuous transversely across the interior of said bat barrel to stiffen the transition zone at a proximal end of the hitting zone of the bat.

3. The metal bat as defined in claim 1 wherein said closed distal end includes a second hardenable material which is continuous transversely across the interior of the bat barrel at the distal end of the bat to stiffen the distal end of the hitting zone.

4. The metal bat as defined in claim 1 and further including a stiffening and closing element at the closed distal end of said barrel, said transverse wall and stiffening and closing element isolating the hitting zone at approximately each end thereof.

5. The metal bat as defined in claim 1 wherein said sponge-like member has a generally spherical shape.

6. The metal bat as defined in claim 1 wherein said sponge-like member has cell openings therein and said hardenable material is received in at least a portion of said cell openings to lock said sponge-like member into said transverse wall.

7. The bat as defined in claim 1 wherein a second sponge-like member is inserted into an open end of the hitting end of the bat into engagement with the hardenable material before hardening and additional hardenable material is poured into said open end into engagement with the second sponge-like member to stiffen the bat barrel approximately at the juncture of the hitting zone and transition zone.

8. The method of stiffening a transition zone of a tubular metal bat adjacent a proximate end of the hitting zone, which comprises the steps of inserting a resilient member into an open end of the bat, moving the resilient member longitudinally inwardly into the transition zone with the resilient member partially compressed by the inner surface of the bat to frictionally retain the resilient member in adjusted position, orienting the bat in generally vertical position with the open end uppermost, and dispensing a hardenable material into the open end of the bat and into engagement with the resilient member to form a transverse wall when the hardenable material is hardened to stiffen the juncture between the transition zone and hitting zone of the bat.

9. The method as defined in claim 8 wherein the step of inserting a resilient member includes the step of inserting a resilient sponge-like ball having a diameter greater than the interior diameter of the bat barrel to frictionally engage the interior surface of the bat barrel and prevent flow of hardenable material past the sponge-like ball.

10. The method as defined in claim 9 wherein said resilient sponge-like ball has cellular openings and said hardenable material is dispersed into a portion of said cellular openings.

* * * * *